United States Patent [19]

Mitchell

[11] 4,199,917

[45] Apr. 29, 1980

[54] APPLYING A STRETCH FILM LID TO A CUP

[75] Inventor: Richard P. Mitchell, Neenah, Wis.

[73] Assignee: American Can Company, Greenwich, Conn.

[21] Appl. No.: 973,126

[22] Filed: Dec. 26, 1978

[51] Int. Cl.[2] ..... B65B 53/00; B65B 7/28

[52] U.S. Cl. ..... 53/441; 53/487; 53/488; 53/556; 53/575; 53/294

[58] Field of Search ..... 53/441, 453, 456, 464, 53/487, 488, 221, 294, 556, 559, 563, 575

[56] References Cited

U.S. PATENT DOCUMENTS

| | | | |
|---|---|---|---|
| 1,826,930 | 10/1931 | Goewey | 53/294 |
| 1,955,949 | 4/1934 | Couton | 53/487 |
| 2,218,293 | 10/1940 | Muller | 53/221 |
| 3,849,972 | 11/1974 | Pepmeier et al. | 53/221 X |
| 3,851,440 | 12/1974 | Horsky | 53/441 |
| 4,011,119 | 3/1977 | Mitchell et al. | 53/487 X |
| 4,070,852 | 1/1978 | Mitchell et al. | 53/297 X |
| 4,078,360 | 3/1978 | Balzer et al. | 53/296 X |

FOREIGN PATENT DOCUMENTS

| | | | |
|---|---|---|---|
| 338761 | 11/1930 | United Kingdom | 53/294 |
| 539599 | 9/1941 | United Kingdom | 53/294 |
| 564706 | 10/1944 | United Kingdom | 53/294 |

*Primary Examiner*—John Sipos

*Attorney, Agent, or Firm*—Robert P. Auber; Ira S. Dorman; Thomas D. Wilhelm

[57] ABSTRACT

A device for applying a stretch film lid to a cup has a planar stretching member, including a relatively rigid peripheral portion, and a multiplicity of finger elements spaced thereabout and extending inwardly therefrom. The finger elements are readily displaceable from the plane of the stretching member, and define, upon displacement, a passageway configured to permit the cup to pass through. Securing means is engageable with the stretching member to secure a stretch film thereto. When a cup is urged against the stretching member, it displaces the finger elements, thereby defining the passageway, with the finger elements and securing means cooperating to extend the stretch film along a plurality of axes, to permit the application of the stretched film to the cup.

24 Claims, 7 Drawing Figures

FIG. 1
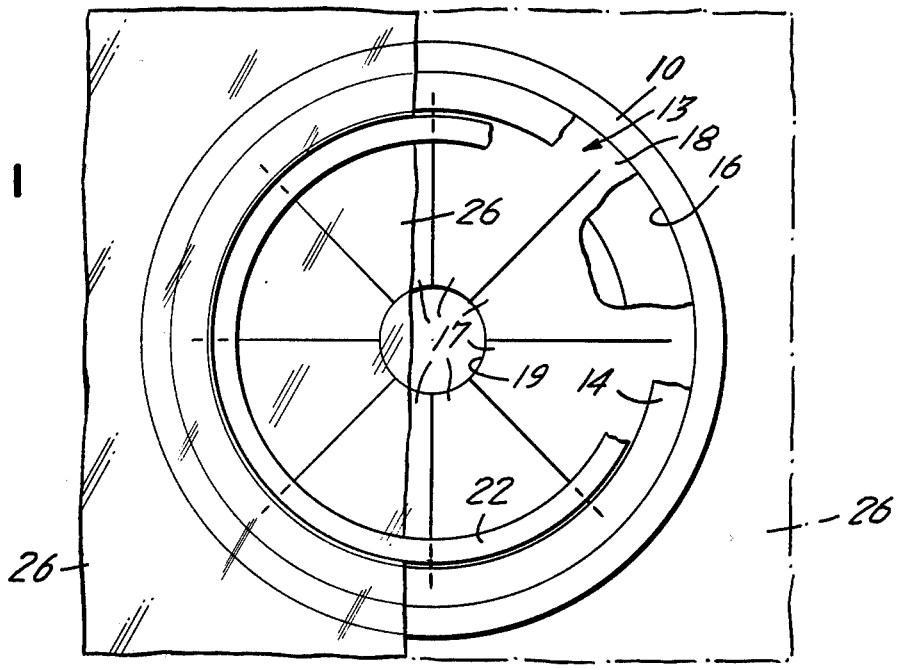
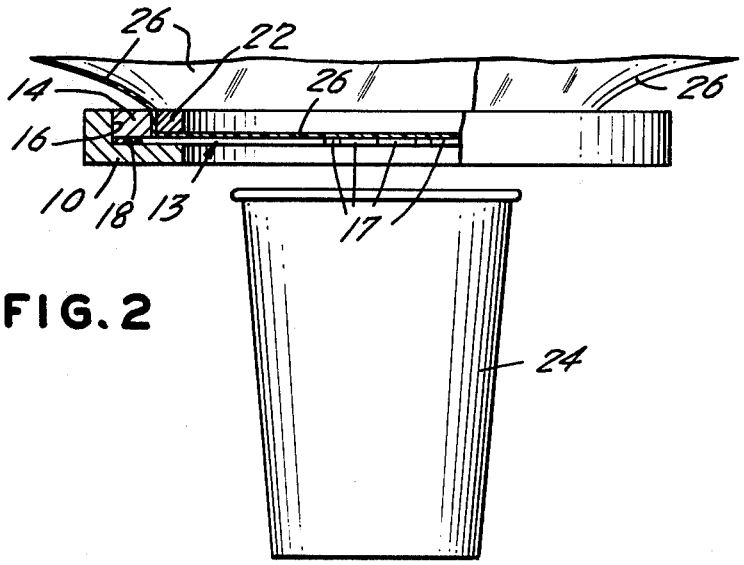
FIG. 2
FIG. 3
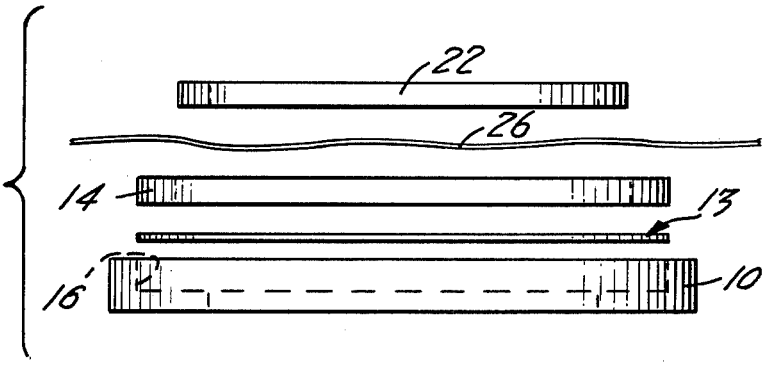

FIG. 5
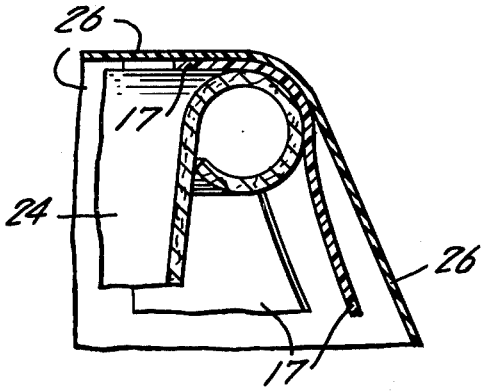
FIG. 6
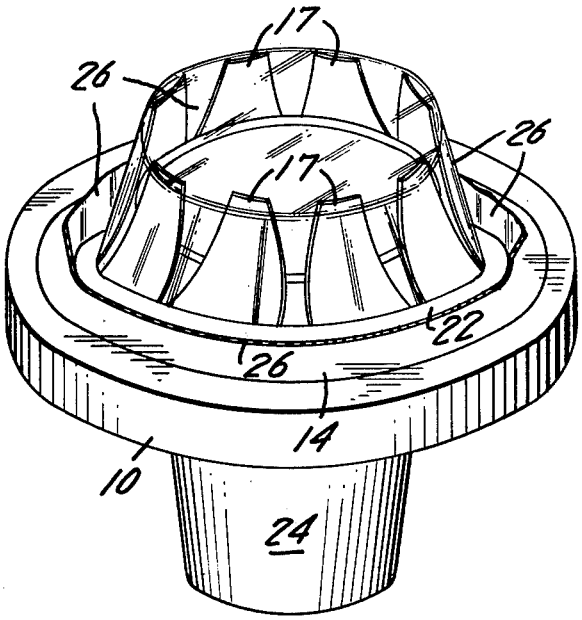
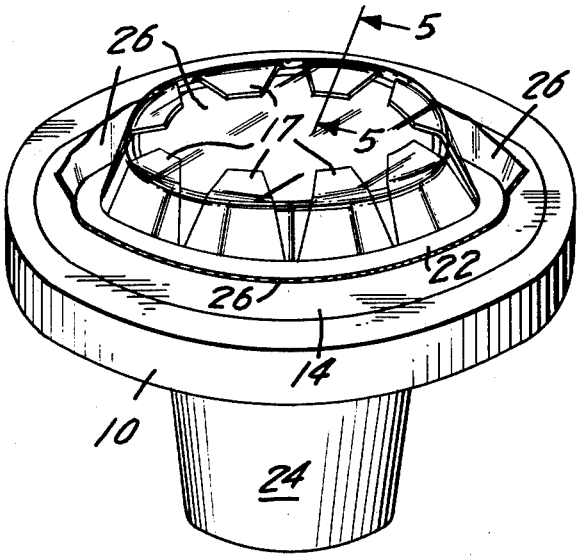
FIG. 4
FIG. 7
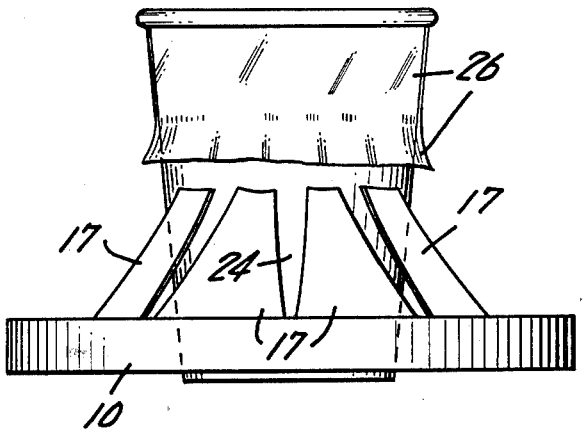

APPLYING A STRETCH FILM LID TO A CUP

BACKGROUND OF THE INVENTION

In two recently issued United States Patents covering inventions of which I am a coinventor, namely U.S. Pat. Nos. 4,011,119 and 4,070,852, a detailed discussion of the problems associated with lidding of disposable cups is provided. Means is disclosed therein for providing a cup closure which is, in at least some respects, functionally superior to conventional preformed plastic lids. This is achieved by cold vacuum stretching a web of elastomeric film over a cup, and thereafter releasing the web to allow the inherent restorative properties of the film to cause it to contract about the periphery of the cup, and to actively conform thereto, thereby forming a seal which is maintained, notwithstanding the deformation that occurs in normal use.

While highly effective and facile to use in the manner described therein, the apparatus taught in the foregoing patents is rather complicated and costly. Accordingly, it was desirable to develop a simpler, less expensive, and more portable device which would be capable of achieving substantially the same result.

A recently issued United States Patent to Balzer et al, U.S. Pat. No. 4,078,360, describes an apparatus for sealing a film onto the top of a cup by application of heat and direct contact between the heating apparatus and the film. This patent relies on the heat seal rather than the elastomeric restorative forces disclosed in this application, and hence entails evident disadvantages.

Muller teaches, in U.S. Pat. No. 2,218,293, method and apparatus for wrapping an article in cellophane, which require the cellophane to be first emplaced against the article, then wiped along its sides as the article is passed through the wrapping device. There is no mention of a method or device for substantially stretching a film for emplacement on a cup or similar article, and the device disclosed would not function in that manner.

In U.S. Pat. No. 3,849,972, Pepmeier teaches apparatus for applying to a cup a film lid, which film (e.g., of polyvinyl chloride) has a tendency to cling to itself, or to parts of the cup or to the apparatus. The cup is urged against the individual film and through an opening surrounded by resilient members, which externally press the film against the side of the cup, and fold it against itself. There is no mention of stretching the film. Nor is there any provision for holding the film against disengagement from the device during application of the film lid.

Finally, in U.S. Pat. No. 3,851,440, Horsky teaches an apparatus for wrapping lettuce, the use of which includes the step of passing the already wrapped product through a perforated disk having flexible fingers, which fingers serve to sweep the excess film over the wrapped lettuce to thereby form an overlying envelope. While Horsky employs a disk which appears similar to one of the components of applicant's device, there is no teaching which would lead to applicant's invention. Further, the combination of that disk with any combination of the other components of Horsky's disclosure does not provide a device adaptable either to function in the same manner or to provide the same wrapped product as applicant's invention.

It is therefore an object of this invention to provide a novel device for mechanically stretching an elastomeric film and applying it as a closure to a cup or the like, which device is simple, inexpensive and highly portable.

It is also an object of the invention to provide a novel method for so stretching and applying an elastomeric film, which method is facile and effective.

SUMMARY OF THE DISCLOSURE

It has now been found that certain of the foregoing and related objects of the invention are readily attained in a novel device for applying stretch film to an article, comprising a substantially planar stretching member and securing means engageable therewith. The stretching member includes a relatively rigid peripheral portion, and a multiplicity of finger elements spaced thereabout and extending inwardly therefrom to a central area. The finger elements are readily displaceable from the plane of the stretching member to one side thereof, and are so dimensioned and configured as to define, upon such displacement, a passageway configured to permit the article to pass thereinto. The securing means is engageable with the stretching member about the central area thereof, to temporarily secure against disengagement a length of stretch film thereto, in a position spanning the central area and in face-to-face relation with the "one" side of the stretching member. As a result, an article urged against the finger elements from the other side of the stretching member will displace the elements from their normal disposition to the "one" side thereof, thereby defining the passageway. The finger elements and securing means cooperate to extend, along a plurality of axes, the stretch film secured within the device, thus permitting application of the stretched film to the article.

In preferred embodiments, the stretching member comprises a frame providing the peripheral portion, and an insert mounted within the frame providing the finger elements thereof, with the insert including a marginal portion from which the finger elements extend. In such embodiments, the insert may be a disk of synthetic resinous material, the finger elements may be substantially sectorial, and the marginal portion may be substantially annular, the device thereby being particularly adapted for use with articles of circular cross-section. The finger elements may have arcuate free ends which define a circular aperture in the disk. The securing means may be a rigid retaining ring mounted within the frame, with the frame being annular, having a recessed portion which circumscribes the opening thereof, and being adapted to seat the retaining ring on the "one" side of the stretching member.

In certain embodiments, the finger elements are flexible and capable of conforming to the shape of an article urged against them, so that they serve primarily as bearing members between the article and the stretch film, enabling substantially the full expanse of stretch film inside the securing means to be stretched. In other embodiments, the finger elements are rigid, and tend to remain relatively planar from the point of deflection to the free end of the finger elements, under the forces necessary to stretch the film for application to the article.

Certain objects of the invention are attained in a novel method of applying a stretch film to an article, which includes temporarily securing a stretch film to a stretching member about a central area thereof, and urging the article against the underside of finger elements which are provided, thereby displacing the finger elements from the surface of their normal disposition, and defining a passageway therebetween. As the article is urged further into the passageway, it ultimately is brought into surface contact with the stretched film, after which the film is released from the stretching member, permitting its inherent restorative forces to cause it to contract about and securely engage the article.

In the preferred method, the leading surface of the article is passed beyond the finger elements before the film is released from the stretching member. Ideally, the finger elements will be fabricated of a material having a low coefficient of friction, so that they facilitate sliding movement of the film thereover, thereby functioning most effectively as bearing surfaces.

BRIEF DESCRIPTION OF THE DRAWINGS

FIG. 1 is a plan view of a device embodying this invention, with a stretch film secured thereto; portions being removed to show structural details;

FIG. 2 is a side elevation view of the device of FIG. 1 in partial section, and showing a cup in position for placing a stretch film lid thereto;

FIG. 3 is an exploded side elevation view of the device of FIG. 1;

FIG. 4 is a perspective view of one embodiment of the device of the foregoing figures, showing an intermediate stage of appliction, in which the film is being stretched;

FIG. 5 is an enlarged sectional view taken along line 5—5 of FIG. 4, showing the condition and relationships of the several elements at that stage of application;

FIG. 6 is a perspective view of a second embodiment of the device of the invention, at an intermediate stage of application of a film to a cup; and FIG. 7 is a side elevation view of the device of FIG. 6 and a cup, showing the position of the device at the completion of the lidding operation.

DETAILED DESCRIPTION OF THE ILLUSTRATIVE EMBODIMENTS

Turning now in detail to FIGS. 1–5 of the drawings, therein illustrated is a stretching device embodying the invention, composed of a relatively rigid annular frame 10, a polymeric disk insert generally designated by the numeral 13, an annular insert holding ring 14, and annular film retaining ring 22. The inner circumference of frame 10 is recessed to provide a shoulder portion 16 which circumscribes the opening therein. Insert 13 is dimensioned and configured for mounting within the shoulder portions of the frame 10, as is best seen in FIGS. 1 and 2. The insert 13 has a marginal portion 18 about its outer periphery, and eight sectorial finger elements 17 extending inwardly from the marginal portion 18 to a concentric circular aperture 19, which is defined by arcuate edges on the free ends of the finger elements. Insert holding ring 14 is dimensioned and configured for frictional engagement within the shoulder portion 16 of the frame 10, thereby holding insert 13 securely there-within. Similarly, retaining ring 22 is dimensioned and configured for frictional engagement within the opening of the insert holding ring 14 as will be more fully described hereinafter.

In assembling the device for applying a lid to the cup 24, a piece of stretch film 26 is temporarily secured therein by holding the film 26 between the frame 10 (within which the disk insert 13 and holding ring 14 have previously been assembled) and the rigid retaining ring 22, so as to span the central area thereof. Thereafter, the retaining ring 22 is forced into the holding ring 14, to secure the film 26 against disengagement from the device, under the forces necessary to apply it. When the device is fully assembled, as best seen in FIGS. 1 and 2, stretch film 26 is in face-to-face relationship with insert 13. While it should be appreciated that the operative elements of the device will ideally be so dimensioned as to exert sufficient clamping force to permit application of the film, the assembly can be held together manually during application, if need be; also auxiliary or substitute clamping means may be used if desired.

In FIG. 2, the device is properly oriented over the cup 24 for the application of the film 26 thereto. When the film is urged downwardly, the brim of the cup 24 contacts the finger elements 17 of the insert 13, thereby displacing them upwardly from their normal disposition, and opening a passageway therebetween, into and through which the cup 24 passes. As the finger elements are displaced, they transmit the applied force to the film 26, stretching it along a multiplicity of axes therein. In the embodiment of FIGS. 4 and 5 the finger elements 17 conform to the cup brim, acting as bearing surfaces, initially preventing the film 26 from contacting the cup 24 and thereby facilitating stretching. For that purpose insert 13 may be formed of any flexible, relatively non-stretchable material that is capable of functioning without puncturing the elastomeric film, or failing structurally, and that has a relatively low coefficient of friction. For example, low density polyethylene films, between 3 and 40 mils thick, have been successfully used; preferred films are between 6 and 20 mils thick, with the optimum thickness being about 12 mils.

When more rigid materials are used, as in the embodiment of FIG. 6, the finger elements 17 function more like first class levers than like bearing surfaces, actually stretching the film, rather than simply facilitating mobility over the cup and distributing forces uniformly. For example, using a 40 mil low density polyethylene insert, the finger elements were deflected near the marginal portion of the insert, and remained relatively rectilinear from the points of deflection to the free ends thereof, as shown in FIG. 6.

In any event, after the free ends of the finger elements pass below the brim of the cup the stretched film contacts the cup brim. The film is then released from the lidding device by disengaging the retaining ring 22 from the other parts of the device, and the restorative forces present in the film act to cause it to contract about the cup, clinging to it and thereby creating a dynamic, or active, highly leak resistant seal. FIG. 7 shows a typical relationship that will exist between the cup and the lidding device after application of the film.

Concerning the stretch film 26, per se, the compositions that are suitable will be evident to those skilled in the art; nevertheless, typical materials that may be employed include styrene butadiene copolymer, buna nitrile available from the B. F. Goodrich Chemical Company, Cleveland, Ohio, under the tradename HYCAR, neoprene, ethylene propylene copolymer, polyurethane, polyisoprene (natural and synthetic), styrene butadiene styrene block copolymers and styrene ethylene butadiene styrene block copolymers. Particularly desirable materials are block copolymers of styrene butadiene styrene and styrene ethylene butadiene styrene sold by the Shell Oil Company under the tradenames KRATON 2112 and KRATON G 2701 respectively. Any of the above film materials can be obtained commercially in suitable thicknesses, which will range between about 1 and 5 mils, about 3.0 to 3.5 mils being found particularly satisfactory. Such films have a high tensile strength, with a usual maximum value of about 3000 psi, and a high degree of stretch, normally being capable of as much as 600% elongation. They will exhibit a high elastic restorative capacity or recovery ratio, which should be at least about 85% and preferably about 90–95% of original values.

Although not illustrated, an alternate embodiment of the device may employ a spacer element to space the finger elements and the stretch film from one another, albeit in face-to-face relation. As a result, the free ends of finger elements will be displaced substantially from their normal positions before contacting the stretch film. However, it will be appreciated that, in such a case, the finger elements must be interposed between the cup and the film during at least some phase of the lidding operation, to ensure that they serve their intended function. This employment of the spacer element allows the user to control the amount of stretch imparted to the film lid when emplacing it onto the cup.

In an alternate assembly also not shown, insert holding ring 14 is omitted; and rigid retaining ring 22 is used to temporarily secure both insert 13 and film 26 to the recessed portion 16 of frame 10 during the lidding operation.

Although the device has been described in an embodiment suitable for manual operation, it can be automated by making minor modifications to a few elements and adding the necessary support functions. Specifically: Insert holding ring 14 may be omitted and insert 13 may be loosely confined in its assembly location. For example, insert 13 may be provided in roll form and fed through openings provided in the sidewalls of frame 10. Similarly stretch film 26 can be fed in roll form through the same openings to the lidder assembly. Retaining ring 22 would secure both film 26 and insert 13 to frame 10. This assembly would be particularly suitable for use in an automatic lidding device and inserts 13 and film 26 would automatically advance into position as required. Film 26 would advance after each lidding operation cycle. Inserts 13 would advance after a predetermined number of cycles.

While the assembly and its elements have been described as individual pieces it should be appreciated that certain of the elements can be combined for various reasons of commercial utility. For example, frame 10 and insert 13 could be combined into one element, such as by bonding insert 13 to frame 10 using a suitable adhesive, clamps, or some other retaining member. Insert 13 could likewise be permanently fixed between frame 10 and insert holding ring 14; again by any clamping means conventionally available. Further, frame 10 and insert 13 could be manufactured as one piece, obviating the need for insert holding ring 14. A particularly suitable and inexpensive member may be molded from low density polyethylene including the dimensional equivalents of frame 10 and insert 13 only. Since insert 13 is permanently fixed to frame 10 by the molding operation, retaining ring 14 would not be necessary.

While the lidding of a cup has been illustrated, a wide variety of articles can be covered utilizing the device and method of this invention. Of course, the circumscribed opening of the device must be larger than the transverse dimensions over which the film is to be stretched, and will normally be configured to correspond to the particular item to be covered.

If, for example it is desired to lid a square-topped container, it may be desirable to modify the device to define a square opening therein; it may also be desirable to modify the finger elements to provide the optimum stretching and restorative functions, consistent with the configuration of the device and the article involved.

Thus it can be seen that the present invention provides a novel device for mechanically stretching an elastomeric film and applying it as a closure to a cup or the like, which device is simple, inexpensive and highly portable. The invention also provide a novel method for performing such operations, which method is facile and effective.

Having thus described the invention, what is claimed is:

1. A device for applying stretch film in sheet form to an article, comprising a substantially planar stretching member including a relatively rigid peripheral portion and a multiplicity of finger elements spaced thereabout and extending inwardly therefrom to a central area, said finger elements being readily displaceable from the plane of said stretching member to one side thereof, and being so dimensioned and configured as to define, upon such displacement, a passageway configured to permit the article to pass thereinto; and securing means engageable with said stretching member, about said area, to temporarily secure a length of stretch film between said securing means and said stretching member in a position spanning said area and in face-to-face relation with said one side of said stretching member, said means being capable of securing the film against disengagement from said stretching member, whereby an article urged against said finger elements from the other side of said stretching member will displace said finger elements from their normal disposition to said one side thereof, defining said passageway, with said finger elements contacting the film, said finger elements and securing means cooperating to affect stretching along a plurality of axes, of said stretch film so secured within said device, to permit application of the stretched film to the article.

2. The device of claim 1 wherein said relatively rigid peripheral portion and said finger elements are components of a unitary structure comprising said stretching member.

3. The device of claim 2 wherein said finger elements are substantially sectorial and said securing means is a rigid retaining ring.

4. The device of claim 1 wherein said stretching member comprises a frame providing said peripheral portion, and an insert mounted with said frame providing said finger elements thereof, said insert including a marginal portion from which said finger elements extend.

5. The device of claims 1, 2 or 4 wherein said finger elements are fabricated of a material having a low coefficient of friction, so that said elements function as bearing surfaces, facilitating sliding movement.

6. The device of claim 4 wherein said insert is a disk of synthetic resinous material, wherein said finger elements are substantially sectorial, and wherein said marginal portion is substantially annular, said device being particularly adapted for use with articles of circular cross-section.

7. The device of claim 6 wherein said finger elements have arcuate free ends which define a circular aperture in said disk.

8. The device of claim 4 wherein said securing means is also mountable within said frame.

9. The device of claim 8 wherein said frame is annular, wherein said insert is a disk, and wherein said securing means is a rigid retaining ring, said frame having a recessed portion which circumscribes the opening thereof and is adapted to seat said retaining ring on said one side of said stretching member, said device being particularly adapted for use with articles of circular cross-section.

10. The device of claims 1, 2 or 4 wherein said finger elements are flexible and will conform to an article urged against them, said finger elements serving primarily as bearing members between the article and the stretch film, whereby substantially the full expanse of stretch film inside said securing means will be stretched.

11. The device of claim 4 wherein said insert is a disk of synthetic resinous material, said finger elements are substantially sectorial, said marginal portion is substantially annular; and wherein said finger elements are flexible and will conform to an article urged against them, said finger elements serving primarily as bearing members between the article and the stretch film, whereby substantially the full expanse of stretch film inside said securing means will be stretched.

12. The device of claim 10 wherein said finger elements have arcuate free ends which define a circular aperture in said stretching member.

13. The device of claim 10 wherein said finger elements are fabricated of a material having a low coefficient of friction, so that said elements function as bearing surfaces, facilitating sliding movement.

14. The device of claim 11 wherein said securing means is also mountable within said frame.

15. The device of claim 14 wherein said frame is annular, and wherein said securing means is a rigid retaining ring, said frame having a recessed portion which circumscribes the opening thereof and is adapted to seat said retaining ring on said one side of said stretching member, said device being particularly adapted for use with articles of circular cross-section.

16. The device of claims 1, 2 or 4 wherein said finger elements are rigid and, under forces necessary to stretch said film for application to the article, remain relatively rectilinear from the point of deflection to the free end of said finger elements.

17. The device of claim 4 wherein said insert is a disk of synthetic resinous mateial, said finger elements are substantially sectorial, said marginal portion is substantially annular; and wherein said finger elements are rigid, under forces necessary to stretch said film for application to the article, remain relatively rectilinear from the point of deflection to the free end of said finger elements.

18. The device of claim 17 wherein said securing means is also mountable within said stretching member.

19. The device of claim 18 wherein said frame is annular, and wherein said securing means is a rigid retaining ring, said frame having a recessed portion which circumscribes the opening thereof and is adapted to seat said retining ring on said one side of said stretching member, said device being particularly adapted for use with articles of circular cross-section.

20. A method of applying a stretch film in sheet form to an article comprising: temporarily securing a stretch film to a substantiall planar stretching member about a central area thereof, said stretching member having a multiplicity of readily displaceable finger elements disposed in a substantially common surface beneath said film and extending inwardly of said central area; urging the article against the underside of said finger elements so as to displace said finger elements from said surface and from the plane of said stretching member and to define a passageway therebetween, said finger elements contacting the film and thereby cooperating to stretch said secured film along a plurality of axes; continuing to urge said article into said passageway and ultimately into surface contact with said stretched film; and releasing said film from said stretching member, whereby restorative forces in said stretched film coact to cause it to contract about said article and cling thereto.

21. The method of claim 20 wherein the leading surface of the article is passed beyond said finger elements before said film is released from said stretching member.

22. The method of claim 20 wherein said finger elements are fabricated of a material having a low coefficient of friction, and said elements function as bearing surfaces, facilitating sliding movement.

23. The method of claim 20 wherein said finger elements are flexible and will conform to an article urged against them, said finger elements serving primarily as bearing members between the article and the stretch film.

24. The method of claim 20 wherein said finger elements are rigid and, under forces necessary to stretch said film for application to the article, remain relatively rectilinear from the point of deflection to the free ends of said finger elements.

* * * * *